US008995885B2

(12) United States Patent
Fujii

(10) Patent No.: US 8,995,885 B2
(45) Date of Patent: Mar. 31, 2015

(54) IMAGE FORMING APPARATUS AND TONER CASE

(71) Applicant: KYOCERA Document Solutions Inc., Osaka (JP)

(72) Inventor: Atsushi Fujii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 15 days.

(21) Appl. No.: 13/897,182

(22) Filed: May 17, 2013

(65) Prior Publication Data

US 2013/0322925 A1 Dec. 5, 2013

(30) Foreign Application Priority Data

May 31, 2012 (JP) ..... 2012-124853

(51) Int. Cl.
*G03G 15/08* (2006.01)
*G03G 21/16* (2006.01)

(52) U.S. Cl.
CPC ..... *G03G 15/0841* (2013.01); *G03G 15/0886* (2013.01); *G03G 21/1633* (2013.01)
USPC ..... 399/258

(58) Field of Classification Search
CPC ..... G03G 15/0832; G03G 15/0836
USPC ..... 399/258
See application file for complete search history.

(56) References Cited

U.S. PATENT DOCUMENTS 5,983,054 A * 11/1999 Kameyama ..... 399/125
2003/0223782 A1* 12/2003 Ban et al. ..... 399/227
2011/0255906 A1* 10/2011 Teramura ..... 399/263

FOREIGN PATENT DOCUMENTS

JP 2009-168856 A 7/2009

OTHER PUBLICATIONS

Machine translation of Nishimura JP 2009-168856 A, publication date:Jul. 30, 2009.*

* cited by examiner

*Primary Examiner* — Walter L Lindsay, Jr.
*Assistant Examiner* — Frederick Wenderoth
(74) *Attorney, Agent, or Firm* — Studebaker & Brackett PC

(57) ABSTRACT

An image forming apparatus includes a toner case, an apparatus main body and a cover. The toner case is attachably/detachably installed to the apparatus main body and includes a case main body having a discharge port discharging a toner, a shutter opening/closing the discharge port and a lever connected with the shutter. The cover is openably/closably attached to the apparatus main body and partly covers the toner case. The lever is shifted to a first position in order to make the shutter close the discharge port and to allow the close of the cover without interfering with the cover, to a second position in order to make the shutter close the discharge port and to interfere with the cover, or to a third position in order to make the shutter open the discharge port and to allow the close of the cover without interfering with the cover.

20 Claims, 12 Drawing Sheets

IMAGE FORMING APPARATUS AND TONER CASE

INCORPORATION BY REFERENCE

This application is based on and claims the benefit of priority from Japanese Patent application No. 2012-124853 filed on May 31, 2012, the entire contents of which are incorporated herein by reference.

BACKGROUND

The present disclosure relates to an image forming apparatus and a toner case installed to the image forming apparatus.

An electrographic image forming apparatus carries out the development process by supplying a toner (a developer) from a development device to an electrostatic latent image formed on the surface of a photosensitive drum or the like. The toner used in such development process is supplied from a toner case configured to be attachable and detachable to an apparatus main body of the image forming apparatus.

The above-mentioned toner case includes a case main body having a discharge port discharging the toner and a shutter opening/closing the discharge port. For example, the shutter rotatably installed to the case main body and opening/closing the discharge port in accordance with the rotation is known. In such a technique, a locking member attached to the toner case locks the shutter in a closing state, thereby preventing the toner from leaking from the toner case during transport of the toner case.

The above-mentioned technique is provided presupposing the transport of single toner case. In this case, the toner case is separately packed from the apparatus main body, and accordingly, the capacity and number of the packaging material are unnecessarily increased, thereby incurring an increase of a packaging cost.

Moreover, in the imaging forming apparatus including the tone case configured as mentioned above, there is a fear that the toner case is installed, in a situation of the shutter closing the discharge port, to the apparatus main body by operation mistake of a worker, such as a user. However, a technique mentioned above does not take measures for solving the fear and it is difficult to prevent the operation mistake of the worker.

SUMMARY

In accordance with an embodiment of the present disclosure, an image forming apparatus includes a toner case, an apparatus main body and a cover. The toner case is configured to include a case main body having a discharge port configured to discharge a toner, a shutter configured to open/close the discharge port, and a lever connected with the shutter. To the apparatus main body, the toner case is attachably/detachably installed. The cover is openably/closably attached to the apparatus main body and configured to cover at least a part of the toner case. The lever is configured to be shifted to a first position in order to make the shutter close the discharge port and to allow the close of the cover without interfering with the cover, to a second position in order to make the shutter close the discharge port and to interfere with the cover, or to a third position in order to make the shutter open the discharge port and to allow the close of the cover without interfering with the cover.

Furthermore, in accordance with an embodiment of the present disclosure, a toner case is attachably/detachably installed to an apparatus main body of an image forming apparatus and covered by a cover openably/closably attached to the apparatus main body. The toner case includes a case main body, a shutter and a lever. The case main body has a discharge port configured to discharge a toner. The shutter is configured to open/close the discharge port. The lever is configured to connect with the shutter and to be shifted to a first position in order to make the shutter close the discharge port and to allow the close of the cover without interfering with the cover, to a second position in order to make the shutter close the discharge port and to interfere with the cover, or to a third position in order to make the shutter open the discharge port and to allow the close of the cover without interfering with the cover.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
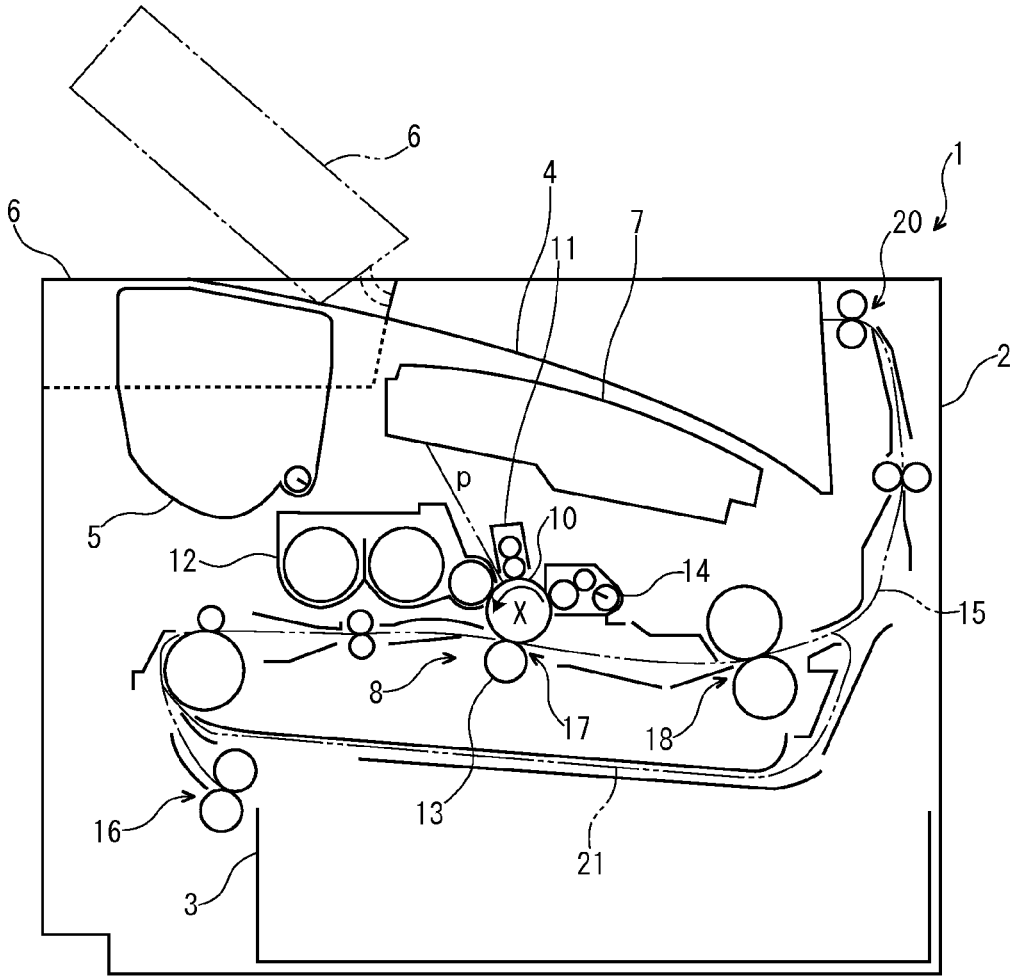
FIG. 1 is a schematic diagram schematically showing a printer according to an embodiment of the present disclosure.

With reference to FIG. 1, the entire structure of an electrographic printer (an image forming apparatus) 1 will be described. FIG. 1 is a schematic diagram schematically showing the printer according to an embodiment of the present disclosure. Hereinafter, it will be described so that the front side of the printer 1 is positioned at the left-hand side of FIG. 1.

The printer 1 includes a box-formed printer main body 2 (apparatus main body). To a lower part of the printer main body 2, a sheet feeding cartridge 3 configured to store sheets (not shown) is installed and, on the top surface of the printer main body 2, an ejecting tray 4 is mounted. To the upper front part of the printer main body 2, a toner container 5 as a toner case is attachably/detachably installed and, above the toner container 5, an upper cover 6 (cover) is openably/closably attached.

To an upper part of the printer main body 2, an exposure device 7 composed of a laser scanning unit (LSU) is installed below the sheet ejecting tray 4. Below the exposure device 7, an image forming unit 8 is installed. To the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Figure 2:
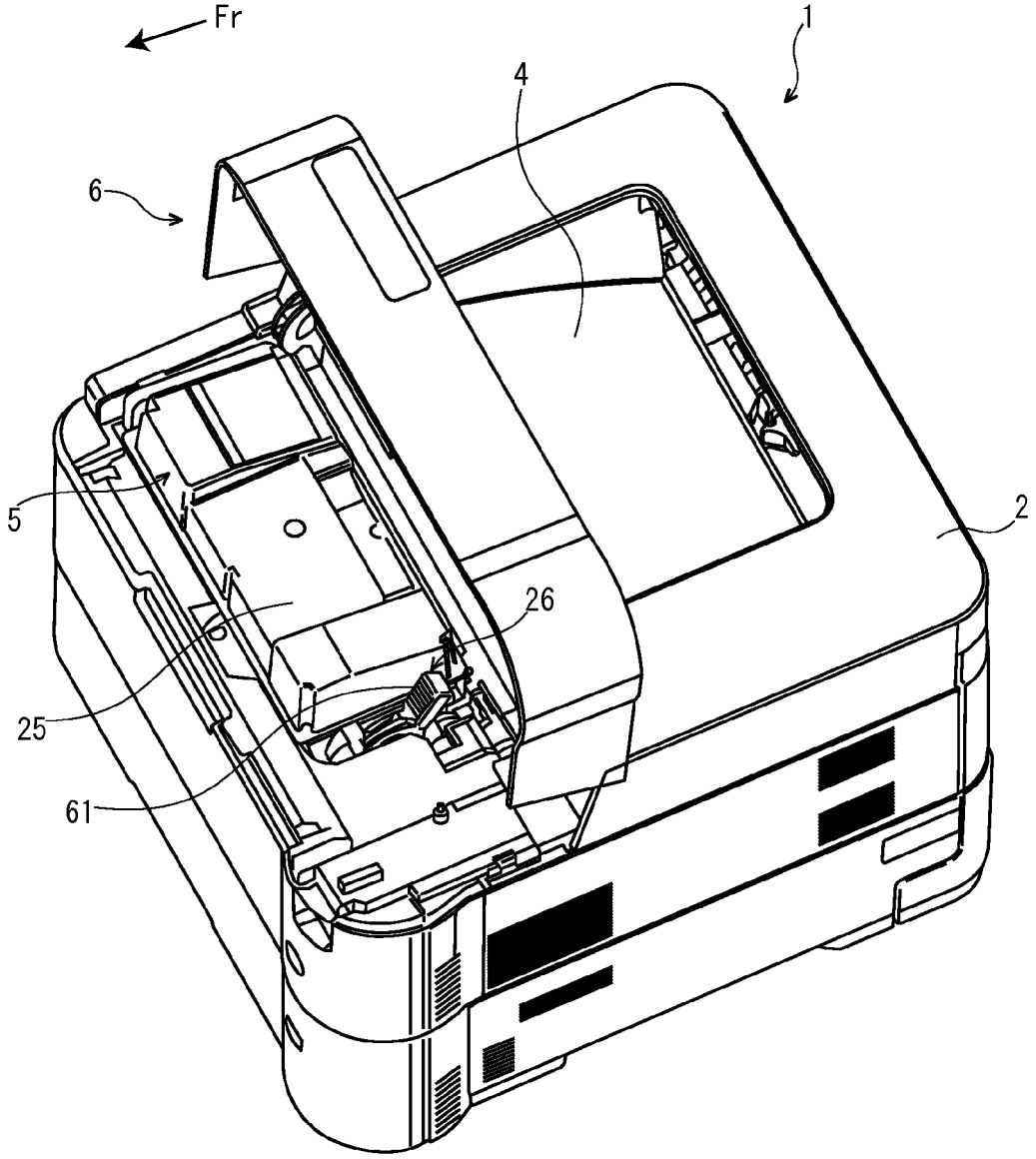
FIG. 2 is a perspective view showing the printer in a situation, in which an upper cover is opened, according to the embodiment of the present disclosure.
Figure 3:
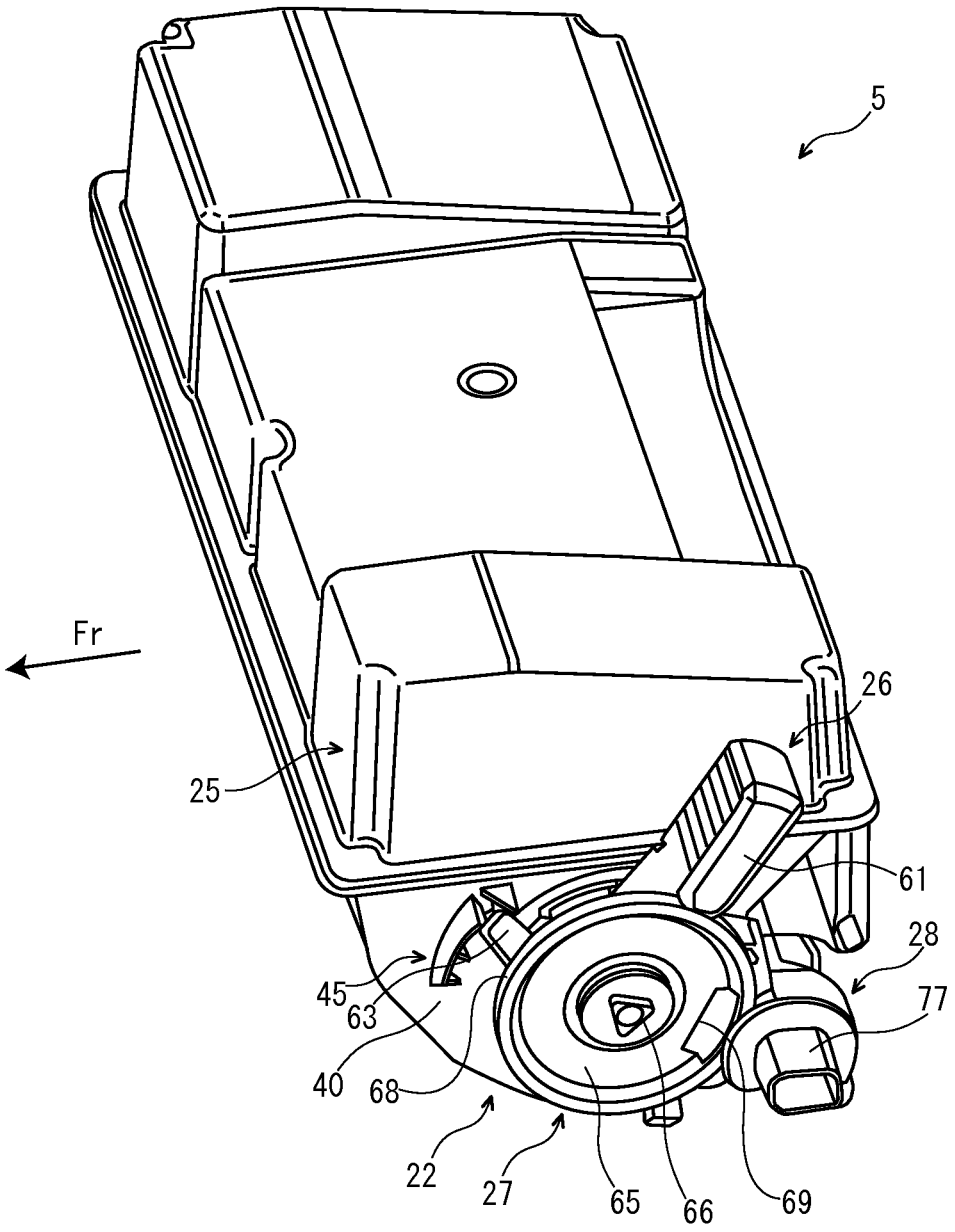
FIG. 3 is a right top perspective view showing a toner container in the printer according to the embodiment of the present disclosure.
Figure 4:
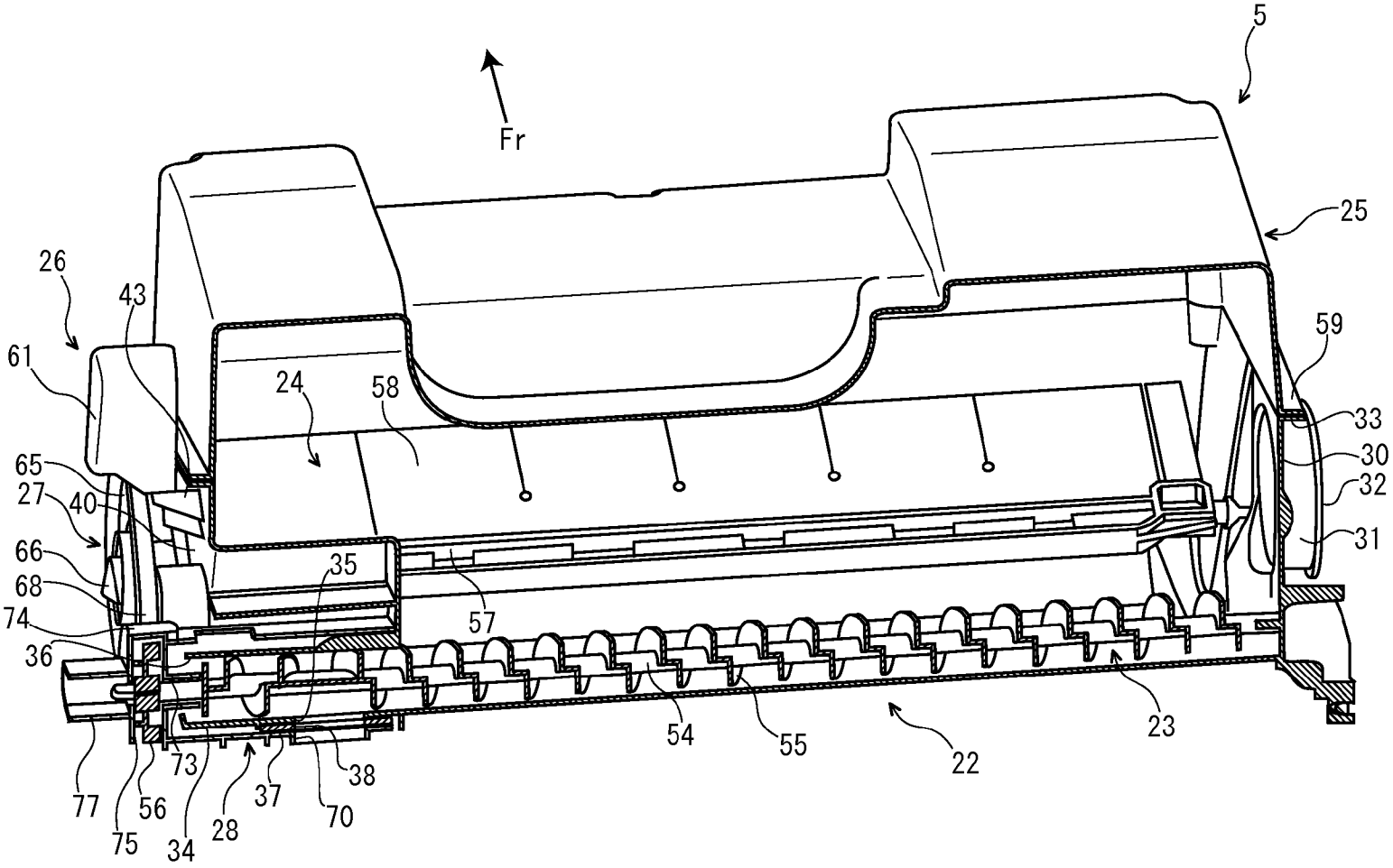
FIG. 4 is a back perspective sectional view showing the toner container in the printer according to the embodiment of the present disclosure.
Figure 5:
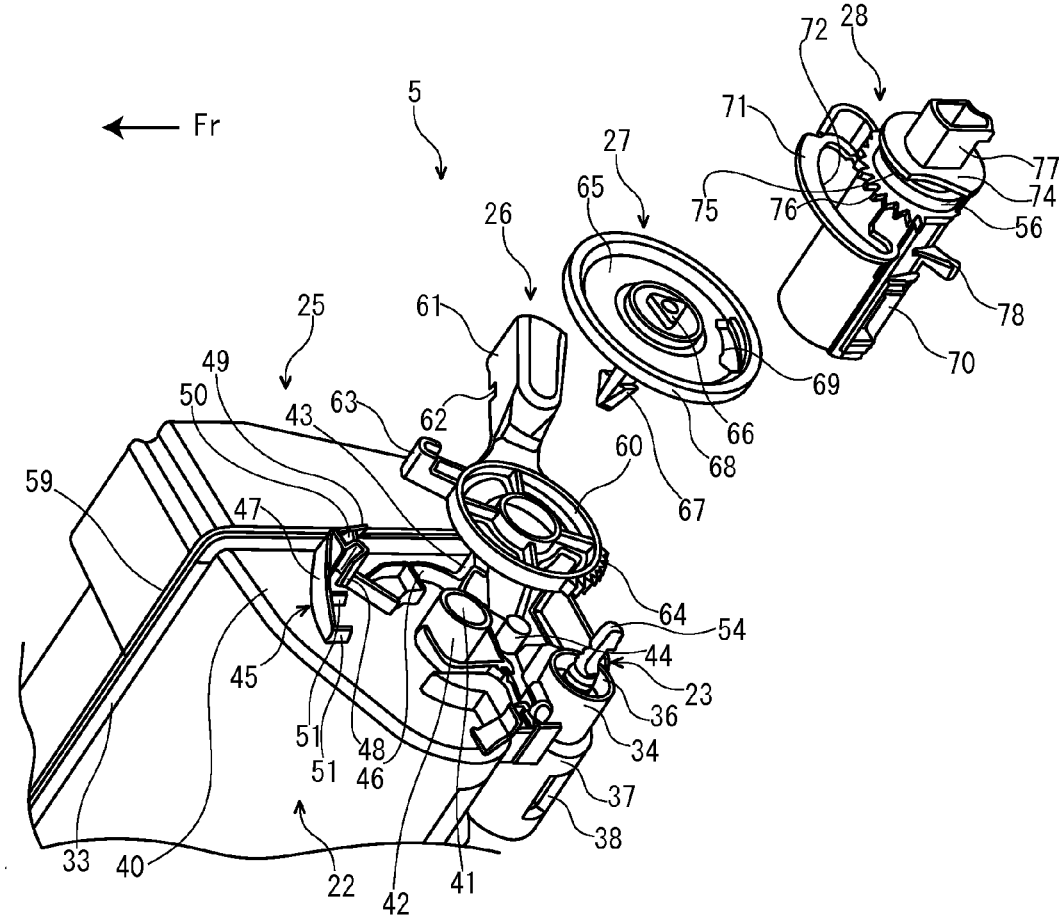
FIG. 5 is an exploded perspective view showing the toner container in the printer according to the embodiment of the present disclosure.
Figure 6:
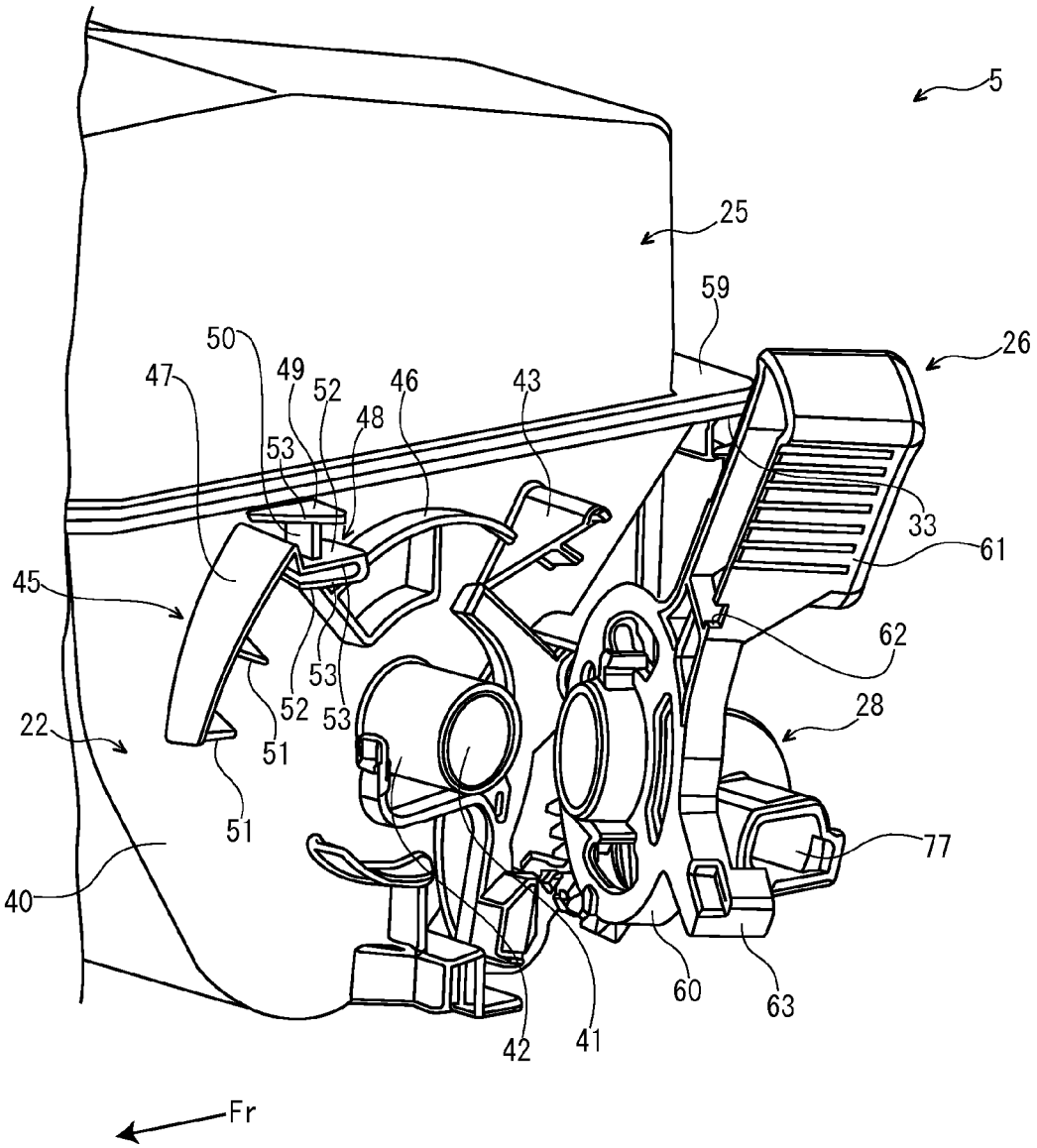
FIG. 6 is a front right perspective view showing the toner container in a situation, in which a lever is detached from a case main body, in the printer according to the embodiment of the present disclosure.
Figure 7:
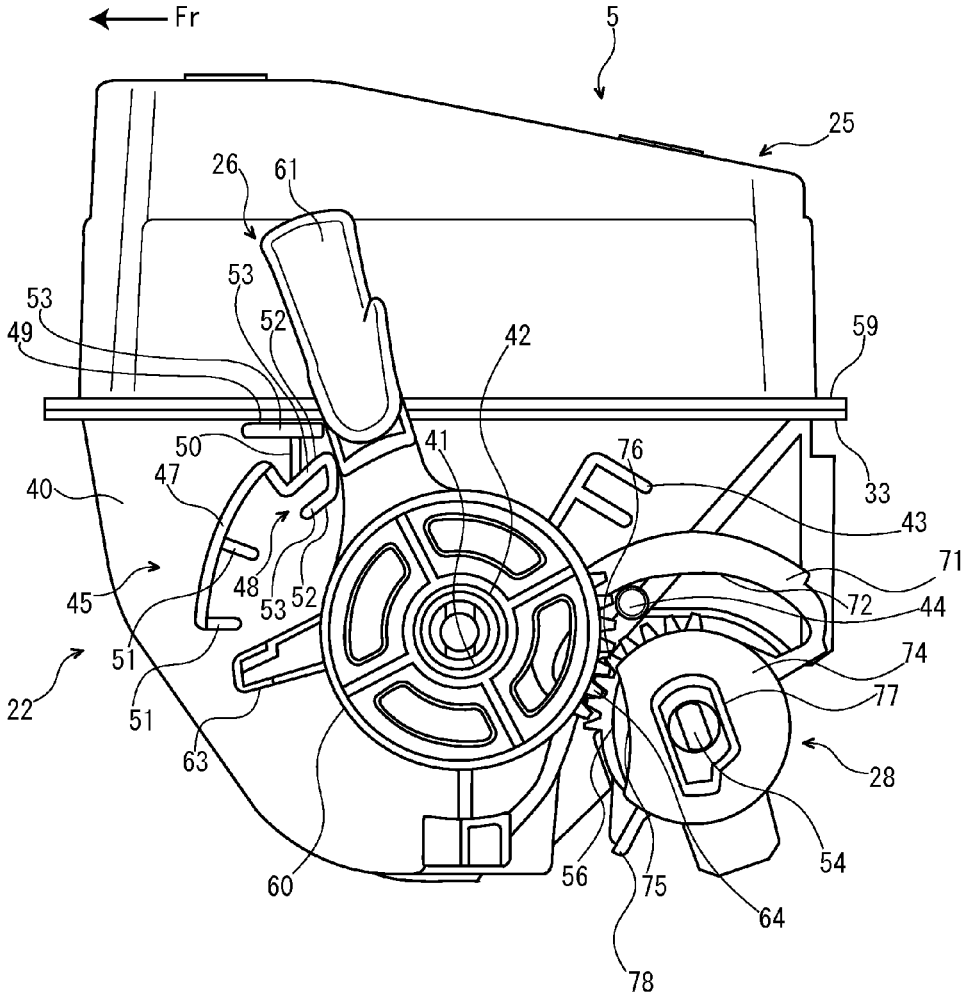
FIG. 7 is a right side view showing the toner container in the printer according to the embodiment of the present disclosure.

Next, with reference to FIGS. 2-7, the toner container 5 will be described in detail. FIG. 2 is a perspective view showing the printer in a situation, in which the upper cover is opened, according to the embodiment of the present disclosure. FIG. 3 is a right top perspective view showing the toner container in the printer according to the embodiment of the present disclosure. FIG. 4 is a back perspective sectional view showing the toner container in the printer according to the embodiment of the present disclosure. FIG. 5 is an exploded perspective view showing the toner container in the printer according to the embodiment of the present disclosure. FIG. 6 is a front right perspective view showing the toner container in a situation, in which a lever is detached from a case main body, in the printer according to the embodiment of the present disclosure. FIG. 7 is a right side view showing the toner container in the printer according to the embodiment of the present disclosure.

Figure 8:
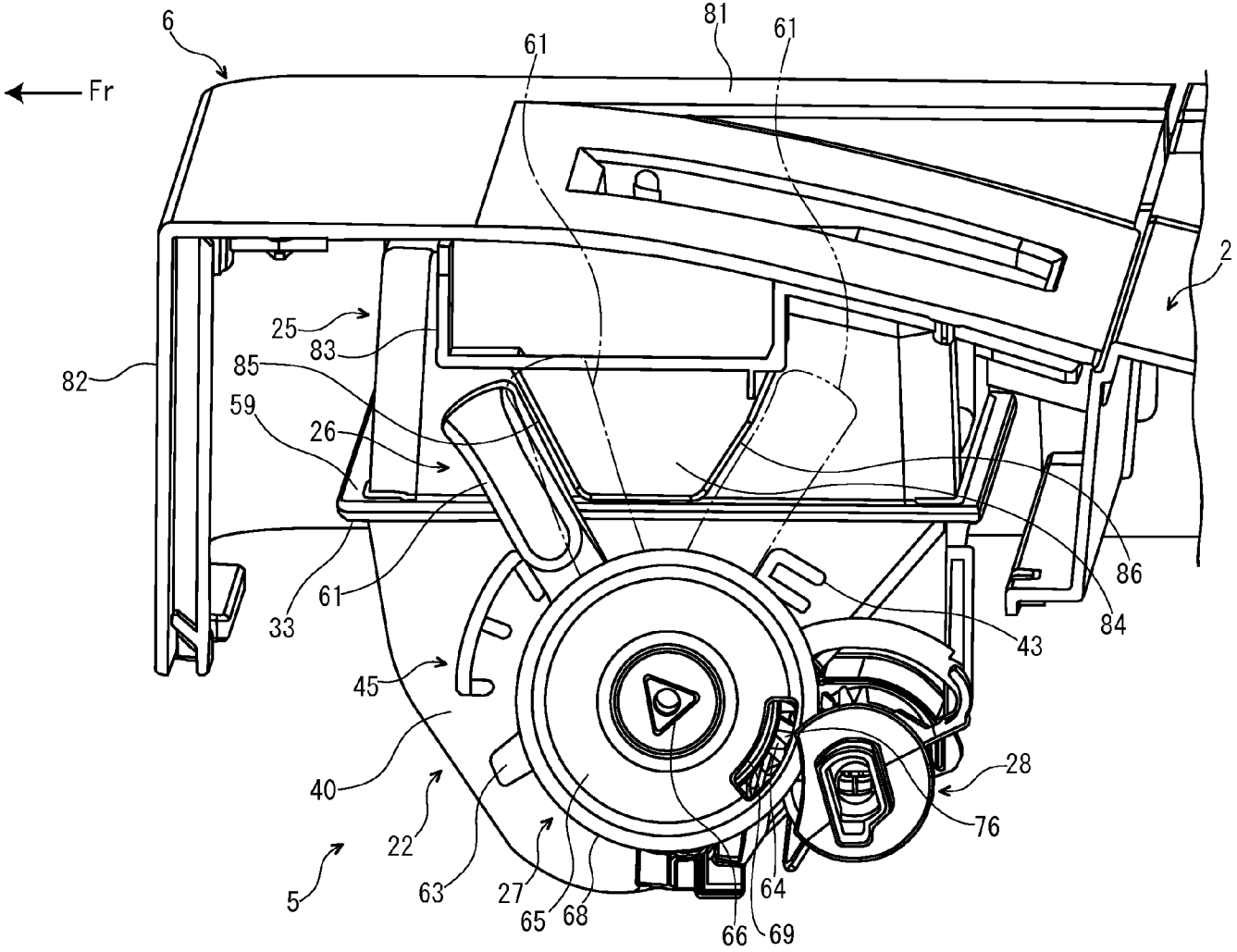
FIG. 8 is a perspective view showing the printer in a situation, in which the upper cover is closed, according to the embodiment of the present disclosure.

Arrow Fr suitably put on each figure indicates the front side of the printer 1 (FIG. 8 and other figure is illustrated in similar way). Because FIG. 4 is the back perspective sectional view, the left-hand and right-hand sides of the figure are converse to the actual left-hand and right-hand sides. That is, the right-hand side illustrated in FIG. 4 is the left-hand side of the toner container 5 and the left-hand side illustrated in FIG. 4 is the right-hand side of the toner container 5.

As shown in FIG. 2, the toner container 5 is located below the upper cover 6. The toner container 5 is also attachably/detachably installed at a top surface of the development device 12 (refer to FIG. 1) to the printer main body 2. As shown in FIG. 3, the toner container 5 is formed in an extended-shape in left and right directions or a horizontal direction.

As shown in FIG. 4, the toner container 5 includes a box-formed case main body 22 with an opened top surface, a conveying screw (a rotating member) 23, a stirring paddle (another rotating member) 24, a covering body 25, a lever 26, a transmitting member 27 and a shutter 28. The conveying screw 23 is installed to a lower rear part of the case main body 22. The stirring paddle 24 is installed near a center part of the case main body 22. The covering body 25 covers the top surface of the case main body 22. The lever 26 is attached to a right end of the case main body 22. The transmitting member 27 is placed on the right end of the case main body 22 together with the lever 26. The shutter 28 is attached on a right bottom end of the case main body 22. The transmitting member 27 is omitted in FIGS. 6 and 7.

The case main body 22 is formed in an extended-shape in the horizontal direction to contain the toner. On a left end wall 30 of the case main body 22, a toner filling port 31 is formed and the toner filling port 31 is closed by a cap 32. On the circumference of a top end of the case main body 22, a main body side flange 33 is formed.

At the right bottom end of the case main body 22, a cylinder-formed discharge duct 34 is protruded to a right direction and, in a right end of the discharge duct 34, an aperture 36 is formed. In a bottom of the discharge duct 34, a discharge port 35 discharging the toner is bored. On the circumference of a lower part of the discharge duct 34, a sealing member 37 is attached and, in the sealing member 37, a communication port 38 is bored at a correspondent position to the discharge port 35.

As shown in FIG. 5, at the center of a right end wall 40 of the case main body 22, a cylinder-formed boss 42 having a communication hole 41 is protruded to a right direction (an outside direction). On a right surface (an external surface) of the right end wall 40 of the case main body 22, a restrain rib 43 is protruded to an upper backward direction of the boss 42. Below the first restrain rib 43, a protrusion 44 is formed.

As shown in FIG. 6 and other figure, on the right surface (the external surface) of the right end wall 40 of the case main body 22, a stopper 45 is protruded to an upper forward direction of the boss 42. The stopper 45 is connected with the restrain rib 43 by a connecting rib 46.

The stopper 45 includes a curved piece 47, an engagement piece 48, a reinforcement piece 49 and a connection piece 50. The curved piece 47 curves in an arc-liked shape around the boss 42. The engagement piece 48 is connected with a rear side of an upper part of the curved piece 47. The reinforcement piece 49 is located above the engagement piece 48. The connection piece 50 connects the engagement piece 48 and reinforcement piece 49. On a lower part and an intermediate part in upper and lower directions or a vertical direction of the curved piece 47, support pieces 51 are protruded backward. The engagement piece 48 is formed in a U-shape laid on side to include a pair of upper and lower engagement plates 52. In the reinforcement piece 49 and engagement plates 52, inclined parts 53 are respectively formed. Each inclined part 53 inclines so that protruded length from the right surface of the right end wall 40 of the case main body 22 is gradually lengthen from a front side to a rear side.

As shown in FIG. 4 and other figure, the conveying screw 23 is formed in an extended-shape in the horizontal direction and installed to the case main body 22 in a rotatable state. The conveying screw 23 includes a bar-formed rotating shaft and a spiral fin 55 concentrically mounted on the circumference of the rotating shaft 54. A left end of the rotating shaft 54 is pivotally supported by the left end wall 30 of the case main body 22. Right side parts of the rotating shaft 54 and spiral fin 55 are inserted into the discharge duct 34. A right end of the rotating shaft 54 protrudes from the discharge duct 34 via the aperture 36 to the right direction and, on the protruding part, a conveying gear 56 is fixedly attached.

The stirring paddle 24 is located above and in front of the conveying screw 23 and formed in an extended-shape in the horizontal direction. The stirring paddle 24 is installed to the case main body 22 in a rotatable state. The stirring paddle 24 includes a supporting frame 57 formed in a frame plate-liked shape and a sheet-formed stirring fin 58 supported by the supporting frame 57. Left and right ends (both horizontal ends) of the supporting frame 57 are pivotally supported by the left end wall 30 and right end wall 40 of the case main body 22. The stirring fin 58 is formed out of plastic sheet, e.g. lumirror. As shown in FIG. 4, one side of the stirring fin 58 is fixedly attached onto the supporting frame 57 along the horizontal direction.

On a bottom end of the covering body 25, a covering body side flange 59 is formed in the correspondent form to the main body side flange 33 of the case main body 22. The main body side flange 33 and covering body side flange 59 are ultrasonic-welded together so that the case main body 22 and covering body 25 are unified.

As shown in FIG. 7, the lever 26 includes a lever main body 60 with a circular profile in a side view. The lever main body 60 is attached on the circumference of the boss 42 arranged on the right surface of the right end wall 40 of the case main body 22. Thereby, the lever 26 is rotatably supported to the case main body 22 so that the lever 26 turns along the right surface of the right end wall 40 of the case main body 22. On an upper part of the lever main body 60, a gripper 61 is protruded to the outside in the radial direction. A top end of the gripper 61 extends to the right side of the covering body 25. As shown in FIG. 6, the gripper 61 is hollow and, in a lower front part of the gripper 61, a depression 62 is formed. On the lever main body 60, a protrusion piece 63 is protruded to the outside in the radial direction at a front side of the gripper 61. On the circumference of a lower rear part of the lever main body 60, lever side gear 64 (refer to FIG. 7) is formed.

As shown in FIG. 5 and other figure, the transmitting member 27 includes a disc-formed transmitting member main body 65. On a right surface (an external surface) of the transmitting member main body 65, a transmission coupling 66 is protruded in the form of a triangle shape in a side view. The transmission coupling 66 is attachably/detachably jointed to a drive coupling 90 (refer to FIG. 9C) connected with a driver 91 (refer to FIG. 9C), such a motor. Accordingly, when the driver 91 makes the drive coupling rotates, this rotation is transmitted to the transmitting member 27, and then, the transmitting member 27 rotates.

As shown in FIG. 5 and other figure, on a left surface (an internal surface) of the transmitting member main body 65, an insertion piece 67 is protruded. The insertion piece 67 is inserted into the communication hole 41 bored in the boss 42 of the case main body 22, and then, jointed to the supporting frame 57 of the stirring paddle 24. Accordingly, when the transmitting member 27 rotates, this rotation is transmitted to the stirring paddle 24, and then, the stirring paddle 24 rotates so that the toner in the case main body 22 is stirred and conveyed to the conveying screw 23.

On the circumference of the transmitting member main body 65, a transmission gear 68 is formed. The transmission gear 68 meshes with the conveying gear 56 of the conveying screw 23. Accordingly, when the transmitting member 27 rotates, this rotation is transmitted to the conveying screw 23, and then, the conveying screw 23 rotates so that the toner in the case main body 22 is discharged from the discharge port 35 and filled into the development device 12 (refer to FIG. 1). In the outside part of the transmitting member main body 65 in the radial direction, an aperture 69 curved in an arc-liked shape is bored.

The shutter 28 is formed in a roughly cylinder-liked shape and rotatably installed to the circumference of the discharge duct 34 of the case main body 22. In a lower surface of the shutter 28, a discharge aperture 70 is bored. As shown in FIG. 7, on the shutter 28, a roughly fan-formed guiding piece 71 is protruded. In the guiding piece 71, an arc-formed guiding hole 72 is formed and, with the guiding hole 72, the protrusion 44 of the case main body 22 engages.

As shown in FIG. 4 and other figure, in the shutter 28, a cylinder-formed bearing 73 is formed and, into the bearing 73, the right end of the rotating shaft 54 of conveying screw 23 is pivotally supported. On the right side of the bearing 73, a gear box 74 is attached and the gear box 74 houses the conveying gear 56. As shown in FIG. 5 and other figure, in the gear box 74, a communication aperture 75 is formed so that the conveying gear 56 can be housed in the gear box 74 via the communication aperture 75.

The shutter 28 is provided with a shutter side gear 76. The shutter side gear 76 meshes with the lever side gear 64 of the lever 26. Thereby, the lever 26 is connected to the shutter 28 so that the shutter 28 turns in the opposite direction to the lever 26 accompanying to the turn of the lever 26. On the right end of the shutter 28, an elliptic locking piece 77 is attached. In a lower part of the shutter 28, a pressing protrusion 78 is formed at the right side of the discharge aperture 70.

Next, with reference to FIG. 8, the upper cover 6 will be described. FIG. 8 is a perspective view showing the printer in a situation, in which the upper cover is closed, according to the embodiment of the present disclosure. Hereinafter, the terms of upper and lower, left and right, and front and back (rear) are used so as to indicate the directions in view of the closed upper cover (refer to FIG. 8).

As shown in FIG. 8, the upper cover 6 includes an upper plate 81 and a front plate 82 and is formed with a roughly L-shaped section. The upper plate 81 covers an upper surface side of the toner container 5 and the front plate 82 covers a front surface side of the toner container 5. The front plate 82 is bended downward from a front end of the upper plate 81.

A rear end of the upper plate 81 is attached to the printer main body 2 via a hinge (not shown) so that the upper cover 6 opens or closes to the printer main body 2 by turning around the hinge as a fulcrum. At an upper surface side of the upper plate 81, an operation unit (not shown) constructed by a liquid crystal display (LCD) or an electric luminescent display (ELD) is provided. According to handling of keys or buttons arranged to the operation unit by a user, the various functions of the printer 1 are actualized.

On an inside surface (a lower surface in the embodiment) of the upper plate 81, a base part 83 in a rectangular shape in a side view is protruded and, to a lower surface of the base part 83, a trapezoid-formed protrusion 84 is attached. On a front end of the protrusion 84, a first guiding face 85 inclined below and backward is formed and, on a rear end of the protrusion 84, a second guiding face 86 inclined below and forward is formed.

Figure 9A:
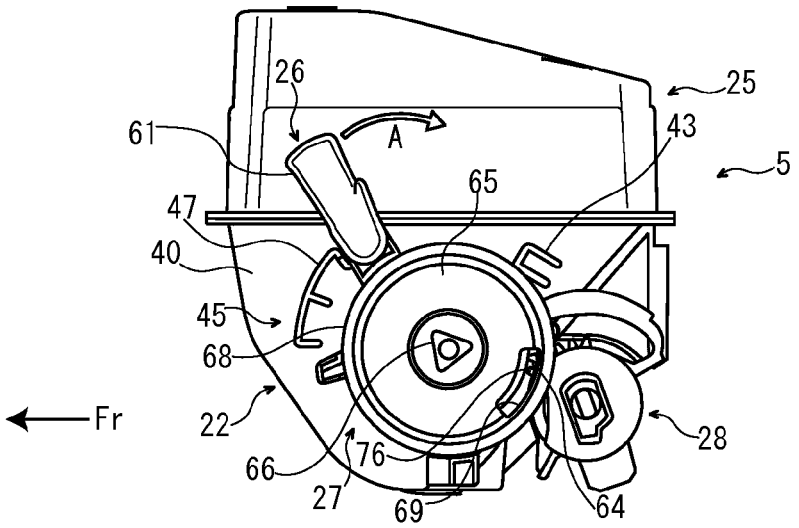
FIG. 9A is a right side view showing the toner container in a situation, in which the lever is located at a first position, in the printer according to the embodiment of the present disclosure.
Figure 9B:
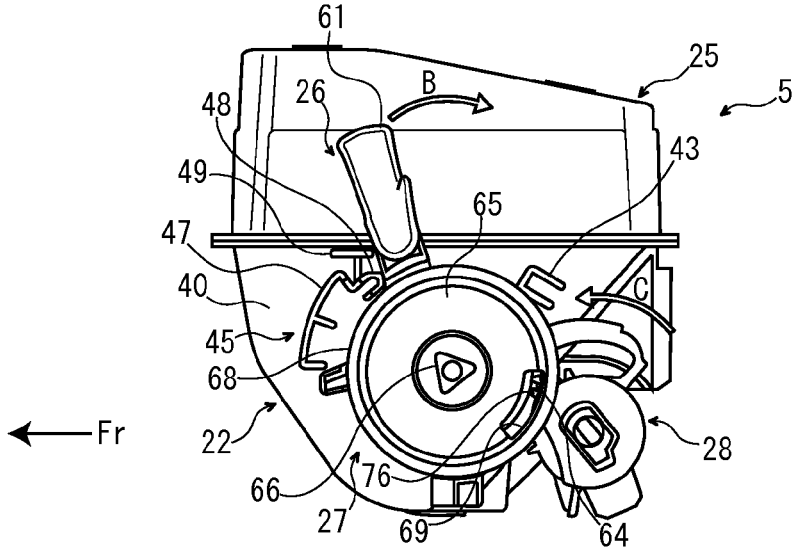
FIG. 9B is a right side view showing the toner container in another situation, in which the lever is located at a second position, in the printer according to the embodiment of the present disclosure.
Figure 9C:
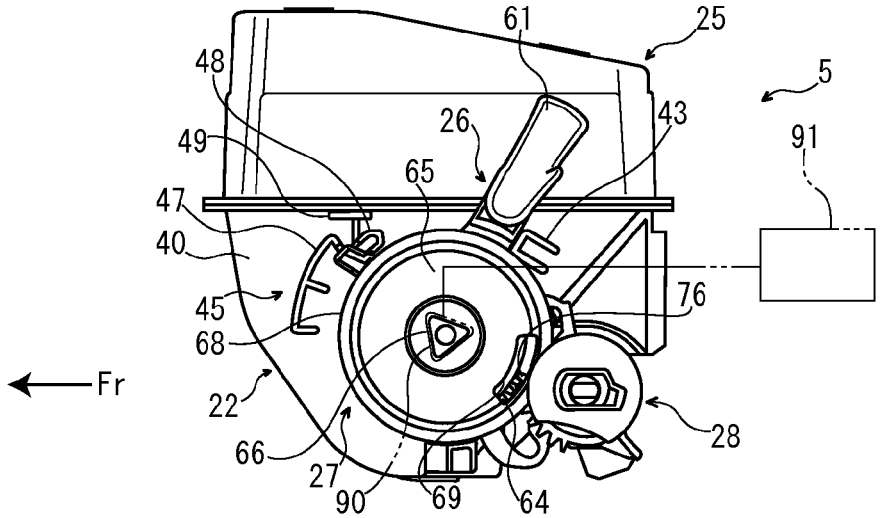
FIG. 9C is a right side view showing the toner container in a further situation, in which the lever is located at a third position, in the printer according to the embodiment of the present disclosure.
Figure 10A:
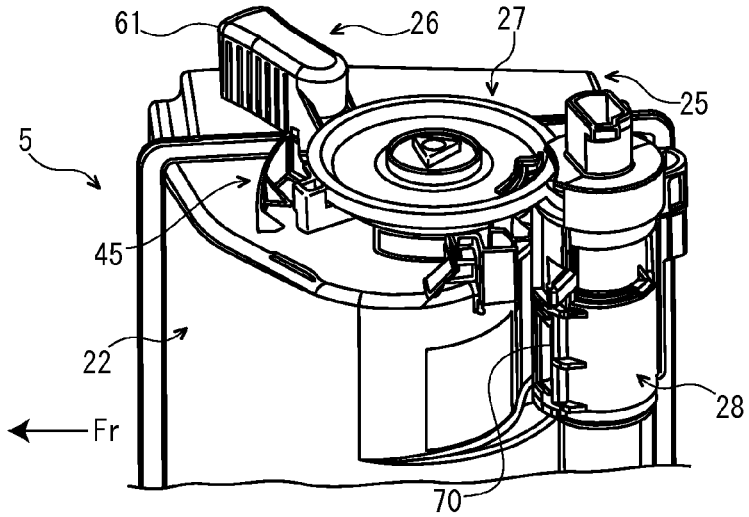
FIG. 10A is a bottom perspective view showing the toner container in a situation, in which the lever is located at the first position, in the printer according to the embodiment of the present disclosure.
Figure 10B:
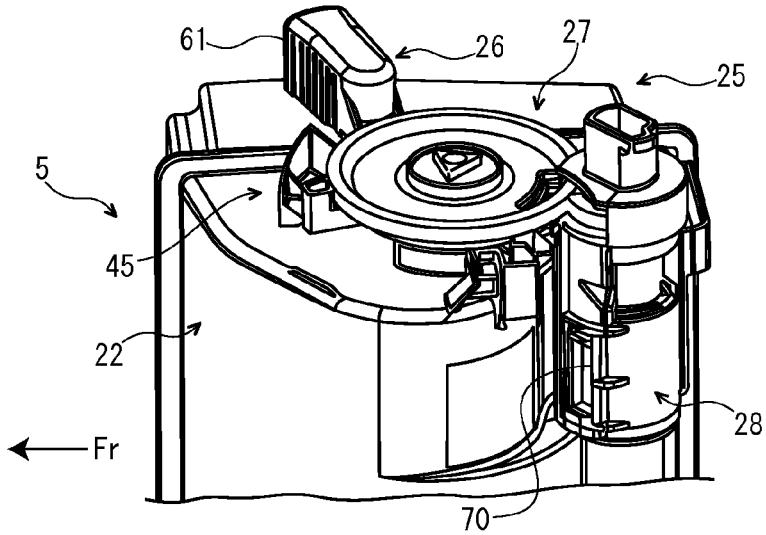
FIG. 10B is a bottom perspective view showing the toner container in another situation, in which the lever is located at the second position, in the printer according to the embodiment of the present disclosure.
Figure 10C:
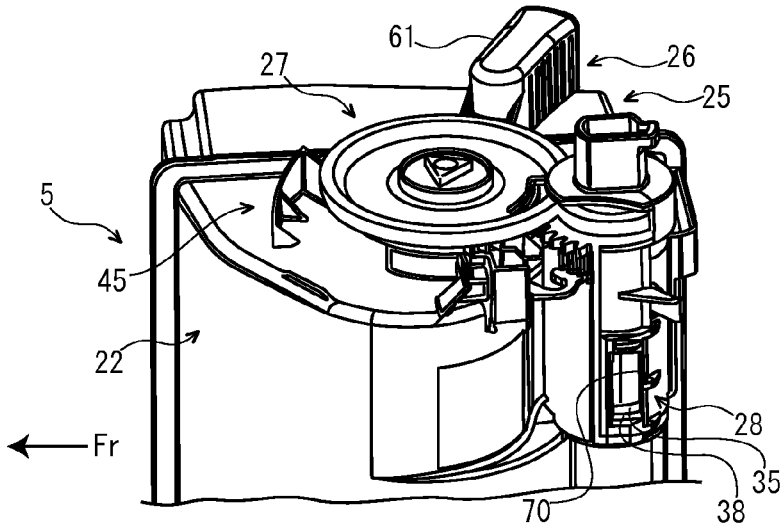
FIG. 10C is a bottom perspective view showing the toner container in a further situation, in which the lever is located at the third position, in the printer according to the embodiment of the present disclosure.
Figure 11A:
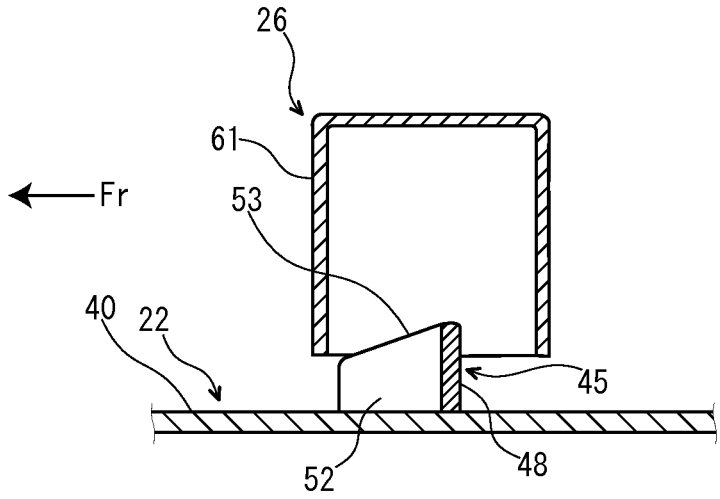
FIG. 11A is a schematic diagram showing the toner container in a situation, in which a gripper of the lever engages with a stopper, in the printer according to the embodiment of the present disclosure.
Figure 11B:
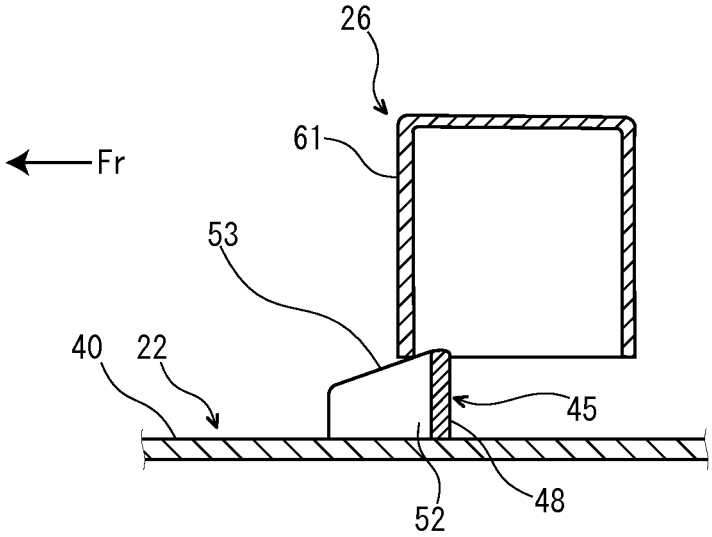
FIG. 11B is a schematic diagram showing the toner container in a another situation, in which the gripper of the lever is going to be shifted from an engaging state with the stopper to a released state, in the printer according to the embodiment of the present disclosure.
Figure 11C:
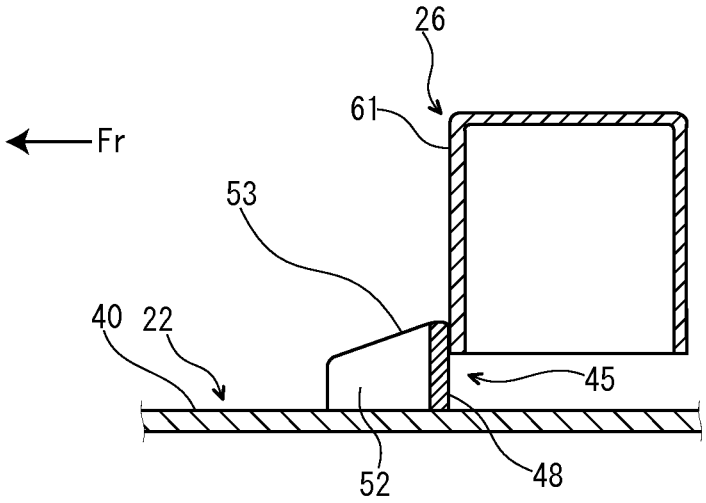
FIG. 11C is a schematic diagram showing the toner container in a further situation, in which the engagement of the gripper of the lever with a stopper is released, in the printer according to the embodiment of the present disclosure.

In the above-mentioned structure, an operation of the lever 26 will be described mainly with reference to FIG. 9A to FIG. 11C. FIG. 9A is a right side view showing the toner container in a situation, in which the lever is located at a first position, in the printer according to the embodiment of the present disclosure. FIG. 9B is a right side view showing the toner container in another situation, in which the lever is located at a second position, in the printer according to the embodiment of the present disclosure. FIG. 9C is a right side view showing the toner container in a further situation, in which the lever is located at a third position, in the printer according to the embodiment of the present disclosure. FIG. 10A is a bottom perspective view showing the toner container in a situation, in which the lever is located at a first position, in the printer according to the embodiment of the present disclosure. FIG. 10B is a bottom perspective view showing the toner container in another situation, in which the lever is located at a second position, in the printer according to the embodiment of the present disclosure. FIG. 10C is a bottom perspective view showing the toner container in a further situation, in which the lever is located at a third position, in the printer according to the embodiment of the present disclosure. FIG. 11A is a schematic diagram showing the toner container in a situation, in which a gripper of the lever engages with a stopper, in the printer according to the embodiment of the present disclosure. FIG. 11B is a schematic diagram showing the toner container in an ongoing situation, in which the gripper of the lever is shifted from an engaging state with the stopper to a released state, in the printer according to the embodiment of the present disclosure. FIG. 11C is a schematic diagram showing the toner container in a situation, in which the engagement of the gripper of the lever with a stopper is released, in the printer according to the embodiment of the present disclosure.

When the printer 1 is taken on market, as shown in FIG. 9A, the gripper 61 of the lever 26 is tilted forward and, as shown in FIG. 10A, the shutter 28 closes the discharge port 35 of the case main body 22. In addition, as shown in FIG. 11A, the gripper 61 of the lever 26 engages with the stopper 45, thereby restricting the turn of the lever 26. A position of the lever 26 at this moment is called as a "first position".

Thus, when the upper cover 6 is shifted to a closing state in a situation, in which the lever 26 is located at the first position, as shown in FIG. 8, the first guiding face 85 of the protrusion 84 of the upper cover 6 faces to the gripper 61 of the lever 26. At that moment, because the gripper 61 of the lever 26 and protrusion 84 of the upper cover 6 are not interfered with each other, the close of the upper cover 6 is allowed.

On the other hand, when the printer 1 is used, as indicated by arrow A in FIG. 9A, a worker, such as a user or a serviceman, pushes the gripper 61 of the lever 26 backward. By this push, as shown in FIG. 11B, the gripper 61 of the lever 26 is shifted backward along the inclined parts 53 of the stopper 45. At that moment, the depression 62 (refer to FIG. 6 and other figures) formed on the gripper 61 of the lever 26 engages with the lower engagement plate 52, thereby slightly decreasing a necessary pushing force for making the lever 26 turned backward. In FIGS. 11A, 11B and 11C, only the inclined part 53 of the upper engagement plate 52 is shown.

When the gripper 61 of the lever 26 is pushed further backward, as shown in FIG. 11C, the gripper 61 of the lever 26 gets over the inclined parts 53 of the stopper 45. Thereby, as shown in FIG. 9B, the engagement of the gripper 61 of the lever 26 with the stopper 45 is released and the lever 26 turns to a slighter back position than the first position. The position of the lever 26 at this time is called as a "second position". Thus, when the lever 26 turns from the first position to the second position, the shutter 28 slightly turns accompanying to this. However, as shown in FIG. 10B, the shutter 28 still closes the discharge port 35 of the case main body 22.

Therefore, even if the close of the upper cover 6 is tried in another situation, in which the lever 26 is located at the second position, as indicated one-dot chain line in FIG. 8, because the gripper 61 of the lever 26 and protrusion 84 of the upper cover 6 are interfered with each other, the close of the upper cover 6 is prevented.

Next, as indicated by arrow B in FIG. 9B, when the worker pushes the lever 26 furthermore backward, as shown in FIG. 9C, the lever 26 turns to a further back position than the second position. The position of the lever 26 at this time is called as a "third position". Thus, when the upper cover 6 is shifted to the closing state in a further situation, in which the lever 26 is located at the third position, as indicated two-dot chain line in FIG. 8, the second guiding face 86 of the protrusion 84 of the upper cover 6 faces to the gripper 61 of the lever 26. At that moment, because the gripper 61 of the lever 26 and protrusion 84 of the upper cover 6 are not interfered with each other, the close of the upper cover 6 is allowed.

Thus, when the lever 26 turns to the third position, as indicated by arrow C in FIG. 9B, the shutter 28 connected with the lever 26 turns, too. Accordingly, as shown in FIG. 10C, the shutter 28 opens the discharge port 35 of the case main body 22, and then, the inside of the case main body 22 and the inside of the development device 12 are communicated with each other. It is therefore possible to supply the toner from the toner container 5 to the development device 12.

When the toner container 5 is replaced, by returning the lever 26 to the second position, the shutter 28 closes the discharge port 35 of the case main body 22. In such a situation, the toner container 5 may be pulled out from the printer main body 2.

As mentioned above, in the embodiment, by installing the toner container 5 to the printer main body 2 in the situation of the lever 26 located at the first position, it is possible to close the upper cover 6 in a situation, in which the shutter 28 closes the discharge port 35 of the case main body 22. Accordingly, it is possible to surely prevent the toner from leaking from the toner container 5 during transport and to take the toner container 5 combined with the printer main body 2 on market. Therefore, the specific packaging material for packing the toner container 5 is unnecessary, thereby decreasing a packaging cost.

In addition, when the printer 1 is used, if the toner container 5 is installed to the printer main body 2 in the other situation of the lever 26 located at the second position, the gripper 61 of the lever 26 and protrusion 84 of the upper cover 6 are interfered with each other, thereby preventing the close of the upper cover 6. Therefore, it is possible to make the worker aware that the upper cover 6 is going to be closed by mistake while the discharge port 35 of the case main body 22 is closed, and then, to prevent the following operation mistake by the worker. Moreover, when the printer 1 is used, if the lever 26 is shifted to the third position, it is possible to close the upper cover 6 in a situation, in which the shutter 28 opens the discharge port 35 of the case main body 22, and then, to carry out the operation of forming the image.

Thus, by switching the position of the lever 26 to the first position, second position or third position, it is possible to surely prevent the toner from leaking from the toner container 5 during the transport, to decrease a packaging cost and to prevent the operation mistake by the worker.

Moreover, in the situation of the lever 26 located at the first position, because the gripper 61 of the lever 26 engages with the stopper 45 to restrict the turn of the lever 26, it is possible to surely maintain the situation of the lever 26 in the first position. Accordingly, it is possible to prevent the lever 26 from turning from the first position to the third position over the second position during the transport of the printer 1 and to prevent the shutter 28 from opening the discharge port 35 of the case main body 22. Therefore, it is possible to prevent failure as leakage of the toner from the toner containers during the transport of the printer 1.

In addition, the embodiment is configured so that the gripper 61 of the lever 26 gets over the inclined parts 53 of the stopper 45, when the gripper 61 of the lever 26 shifts from an engagement state with the stopper 45 to a release state. Therefore, it is possible to prevent the lever 26 turned once from the first position to the second position from going back to the first position again.

Furthermore, it is possible to surely maintain, while the upper cover 6 is closed, the situation of the lever 26 located at the first position or the third position by making the first guiding face 85 or second guiding face 86 formed on the protrusion 84 of the upper cover 6 facing to the gripper 61 of the lever 26.

Figure 12A:
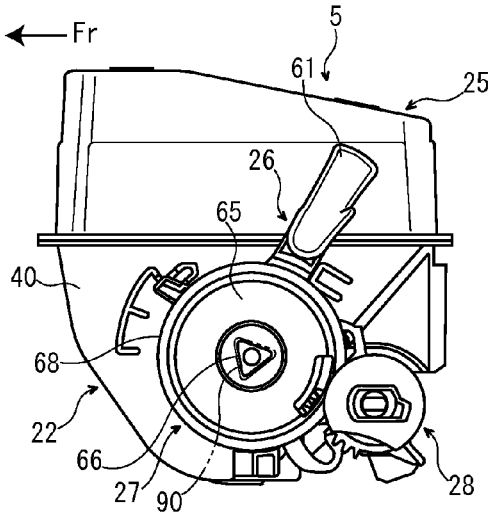
FIG. 12A is a side view showing a transmission coupling in the printer according to the embodiment of the present disclosure.
Figure 12B:
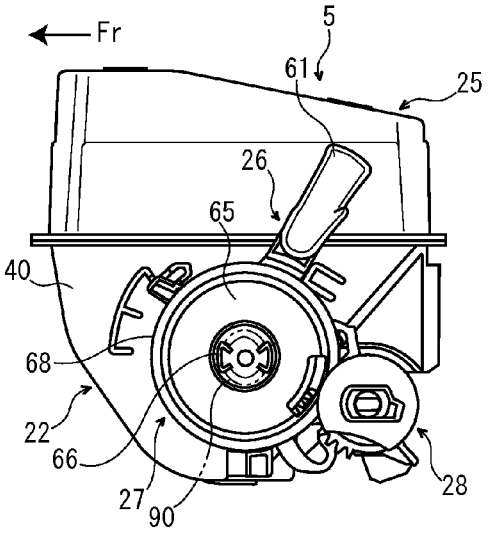
FIG. 12B is a side view showing a roughly fan-formed transmission coupling in the printer according to another embodiment of the present disclosure.
Figure 12C:
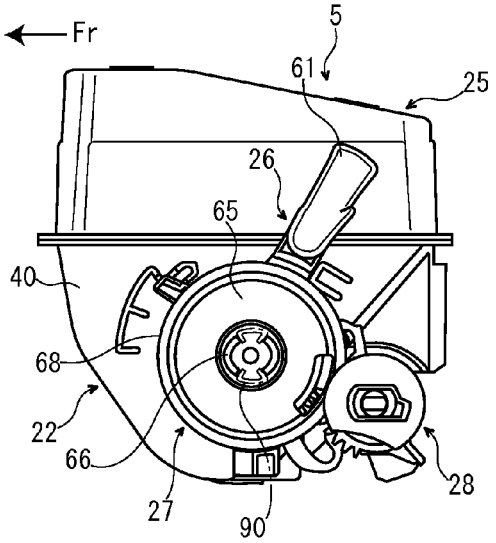
FIG. 12C is a side view showing a roughly arc-formed transmission coupling in the printer according to a further embodiment of the present disclosure.
Figure 12D:
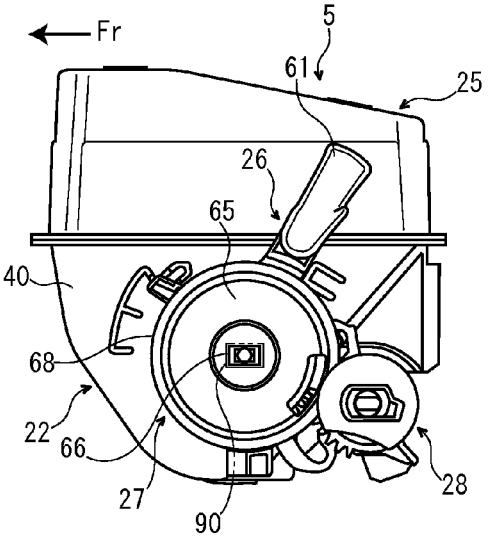
FIG. 12D is a side view showing a rectangle-formed transmission coupling in the printer according to a furthermore embodiment of the present disclosure.

In the embodiment, as shown in FIG. 12A, the transmission coupling 66 is formed in a triangle shape in a side view and the drive coupling 90 attachably/detachably jointed to the transmission coupling 66 is formed in a triangle shape in a side view corresponding to the transmission coupling 66. However, in other embodiments, the transmission coupling 66 may be formed in a roughly fan shape as shown in FIG. 12B, in a roughly arc shape as shown in FIG. 12C or in a rectangular shape as shown in FIG. 12D. In these cases, the drive coupling 90 may be variously formed in a jointable shape with the corresponding to the transmission coupling 66. In particular, if the transmission coupling 66 and drive coupling 90 are differently formed according to each destination, it is possible to prevent the toner container 5 for one destination being installed to the printer main body 2 for another destination and to restrict failure caused by mistaken installation of the toner container 5.

The embodiment was described in case of applying the configuration of the disclosure to the upper cover 6. However, in another embodiment, the configuration of the disclosure may be applied to a front cover, a side cover or another cover.

The embodiment was described in case of forming the lever 26 and shutter 28 separately. However, in a further embodiment, the lever 26 and shutter 28 may be formed in a body.

Although the embodiment was described in a case where ideas of the disclosure are applied to the printer 1, as a furthermore embodiment, the ideas of the disclosure may be applied to another image forming apparatus except the printer 1, such as a copying machine, a facsimile or a multifunction machine.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a toner case configured to include a case main body having a discharge port configured to discharge a toner, a shutter configured to open/close the discharge port, and a lever connected with the shutter;

an apparatus main body to which the toner case is attachably/detachably installed; and a cover openably/closably attached to the apparatus main body and configured to cover at least a part of the toner case, wherein the lever is attached to the case main body and configured to be shifted to a first position in order to make the shutter close the discharge port and to allow the close of the cover without interfering with the cover, to a second position in order to make the shutter close the discharge port and to prevent the close of the cover with interfering with the cover, or to a third position in order to make the shutter open the discharge port and to allow the close of the cover without interfering with the cover.

2. The image forming apparatus according to claim 1, wherein, on an external surface of the case main body, a stopper is protruded, the lever is configured to turn along the external surface of the case main body from the first position to the third position over the second position, the lever in a situation of being located at the first position is configured to engage with the stopper so that turn of the lever is restricted, and when the lever in the situation of being located at the first position is pushed toward the second position, the engagement of the lever with the stopper is released so that the lever is permitted to turn to the second position.

3. The image forming apparatus according to claim 2, wherein the stopper includes an inclined part formed so that a protruded length from the external surface of the case main body is gradually lengthen from a side of the first position to another side of the second position, and when the lever is shifted from an engaging state with the stopper to a released state, the lever gets over the inclined part.

4. An image forming apparatus comprising:

a toner case configured to include a case main body having a discharge port configured to discharge a toner, a shutter configured to open/close the discharge port, and a lever connected with the shutter;

an apparatus main body to which the toner case is attachably/detachably installed; and a cover openably/closably attached to the apparatus main body and configured to cover at least a part of the toner case, wherein the lever is configured to be shifted to a first position in order to make the shutter close the discharge port and to allow the close of the cover without interfering with the cover, to a second position in order to make the shutter close the discharge port and to interfere with the cover, or to a third position in order to make the shutter open the discharge port and to allow the close of the cover without interfering with the cover, wherein, on an external surface of the case main body, a stopper is protruded, the lever is configured to turn along the external surface of the case main body from the first position to the third position over the second position, the lever in a situation of being located at the first position is configured to engage with the stopper so that turn of the lever is restricted, when the lever in the situation of being located at the first position is pushed toward the second position, the engagement of the lever with the stopper is released so that the lever is permitted to turn to the second position, and the stopper includes:

a curved piece configured to curve in an arc-liked shape; and an engagement piece configured to connect with the curved piece, and the engagement piece is further configured to have an inclined part formed so that a protruded length from the external surface of the case main body is gradually lengthen from a side of the first position to another side of the second position, and when the lever is shifted from an engaging state with the stopper to a released state, the lever gets over the inclined part.

5. The image forming apparatus according to claim 4, wherein the stopper further includes a reinforcement piece configured to connect with the engagement piece and to have another inclined part similar to the inclined part.

6. An image forming apparatus comprising:

a toner case configured to include a case main body having a discharge port configured to discharge a toner, a shutter configured to open/close the discharge port, and a lever connected with the shutter;

an apparatus main body to which the toner case is attachably/detachably installed; and a cover openably/closably attached to the apparatus main body and configured to cover at least a part of the toner case, wherein the lever is configured to be shifted to a first position in order to make the shutter close the discharge port and to allow the close of the cover without interfering with the cover, to a second position in order to make the shutter close the discharge port and to interfere with the cover, or to a third position in order to make the shutter open the discharge port and to allow the close of the cover without interfering with the cover, wherein, on an external surface of the case main body, a stopper is protruded, the lever is configured to turn along the external surface of the case main body from the first position to the third position over the second position, the lever in a situation of being located at the first position is configured to engage with the stopper so that turn of the lever is restricted, and when the lever in the situation of being located at the first position is pushed toward the second position, the engagement of the lever with the stopper is released so that the lever is permitted to turn to the second position, and the lever includes:

a lever main body installed to the case main body; and a gripper protruded on the lever main body, and in the situation of the lever located at the first position, the gripper engages with the stopper.

7. The image forming apparatus according to claim 6, wherein the gripper includes a depression, and when the lever in the situation of being located at the first position is pushed toward the second position, the depression engages with the stopper.

8. The image forming apparatus according to claim 1, wherein the toner case includes one or more rotating members rotatably attached to the case main body and a transmitting member being connected with the rotating members and having a transmission coupling, the apparatus main body includes a drive coupling attachably/detachably jointed to the transmission coupling and a driver making the drive coupling rotate, and the transmission coupling and drive coupling are differently formed according to each destination.

9. The image forming apparatus according to claim 8, wherein the rotating members include:

a stifling paddle configured to stir the toner in the case main body, and a conveying screw configured to discharge the toner in the case main body from the discharge port.

10. The image forming apparatus according to claim 1, wherein, on an inside surface of the cover, a protrusion is formed, and the protrusion includes:

a first guiding face configured to face the lever when the cover is closed in a situation of the lever located at the first position; and a second guiding face configured to face the lever when the cover is closed in another situation of the lever located at the third position.

11. A toner case attachably/detachably installed to an apparatus main body of an image forming apparatus and covered by a cover openably/closably attached to the apparatus main body comprising:

a case main body having a discharge port configured to discharge a toner;

a shutter configured to open/close the discharge port; and a lever attached to the case main body and configured to connect with the shutter and to be shifted to a first position in order to make the shutter close the discharge port and to allow the close of the cover without interfering with the cover, to a second position in order to make the shutter close the discharge port and to prevent the close of the cover with interfering with the cover, or to a third position in order to make the shutter open the discharge port and to allow the close of the cover without interfering with the cover.

12. The toner case according to claim 11, wherein, on an external surface of the case main body, a stopper is protruded, the lever is configured to turn along the external surface of the case main body from the first position to the third position over the second position, the lever in a situation of being located at the first position is configured to engage with the stopper so that turn of the lever is restricted, and when the lever in the situation of being located at the first position is pushed toward the second position, the engagement of the lever with the stopper is released so that the lever is permitted to turn to the second position.

13. The toner case according to claim 12, wherein the stopper includes an inclined part formed so that a protruded length from the external surface of the case main body is gradually lengthen from a side of the first position to another side of the second position, and when the lever is shifted from an engaging state with the stopper to a released state, the lever gets over the inclined part.

14. The toner case according to claim 13, wherein the stopper includes:

a curved piece configured to curve in an arc-liked shape; and an engagement piece configured to connect with the curved piece, and the engagement piece is further configured to have the inclined part.

15. The toner case according to claim 14, wherein the stopper further includes a reinforcement piece configured to connect with the engagement piece and to have another inclined part similar to the inclined part.

16. The toner case according to claim 12, wherein the lever includes:

a lever main body installed to the case main body; and a gripper protruded on the lever main body, and in the situation of the lever located at the first position, the gripper engages with the stopper.

17. The toner case according to claim 16, wherein the gripper includes a depression, and when the lever in the situation of being located at the first position is pushed toward the second position, the depression engages with the stopper.

18. The toner case according to claim 11, further comprising one or more rotating members rotatably attached to the case main body and a transmitting member being connected with the rotating members and having a transmission coupling, wherein the apparatus main body includes a drive coupling attachably/detachably jointed to the transmission coupling and a driver making the drive coupling rotate, and the transmission coupling and drive coupling are differently formed according to each destination.

19. The toner case according to claim 18, wherein the rotating members includes:

a stifling paddle configured to stir the toner in the case main body, and a conveying screw configured to discharge the toner in the case main body from the discharge port.

20. The toner case according to claim 11, wherein, on an inside surface of the cover, a protrusion is formed, and the protrusion includes:

a first guiding face configured to face the lever when the cover is closed in a situation of the lever located at the first position; and a second guiding face configured to face the lever when the cover is closed in another situation of the lever located at the third position.

* * * * *